United States Patent [19]

Moskowitz

[11] Patent Number: 4,683,825

[45] Date of Patent: Aug. 4, 1987

[54] ANALOG CAM PROFILE SENSOR SYSTEM

[75] Inventor: I. Moskowitz, Baltimore, Md.

[73] Assignee: Bethlehem Steel Corporation, Bethlehem, Pa.

[21] Appl. No.: 773,619

[22] Filed: Sep. 9, 1985

[51] Int. Cl.[4] ..... B61B 3/00

[52] U.S. Cl. ..... 105/148

[58] Field of Search ..... 104/88, 89, 91, 1 R, 104/250, 303; 105/148, 149; 266/78, 165; 222/604, 608; 246/187 B; 164/155, 457; 414/401, 402

[56] References Cited

U.S. PATENT DOCUMENTS

| | | | |
|---|---|---|---|
| 1,551,557 | 9/1925 | Lowden | 104/91 |
| 3,280,950 | 10/1966 | Magloire | 246/187 B |
| 3,459,312 | 8/1969 | Britcher, Jr. et al. | 266/165 |
| 3,845,715 | 11/1974 | Hochstrasser | 104/1 R |
| 4,033,403 | 7/1977 | Seaton et al. | 164/155 |
| 4,210,192 | 7/1980 | Lavanchy et al. | 164/155 |
| 4,435,250 | 3/1984 | Lindgren | 414/401 |
| 4,538,950 | 9/1985 | Shiomi et al. | 104/1 R |

*Primary Examiner*—Robert B. Reeves

*Assistant Examiner*—Dennis C. Rodgers

*Attorney, Agent, or Firm*—Shlesinger, Arkwright, Garvey & Fado

[57] ABSTRACT

An apparatus for accurately positioning the support member which is carried by a movable member movable along a trackway or the like comprising a fixed cam having an arcuate surface, at least one cam follower engagable with said cam and means for sensing the position of the cam follower relative to the cam so that when the cam follower has reached a predetermined position along the cam the support member is accurately positioned. A sensing means is disclosed including a cam follower shaft attached to the cam follower. An analog shaft angle resolver is rotatably connected to the cam follower shaft so as to measure the angular rotation of the cam follower shaft and produce a voltage corresponding to the angular rotational position of the cam follower shaft. The analog voltage signal is then converted into a digital signal and fed into a digital display which displays a number proportional to the distance the support member is from a predetermined position.

20 Claims, 6 Drawing Figures

FIG 2
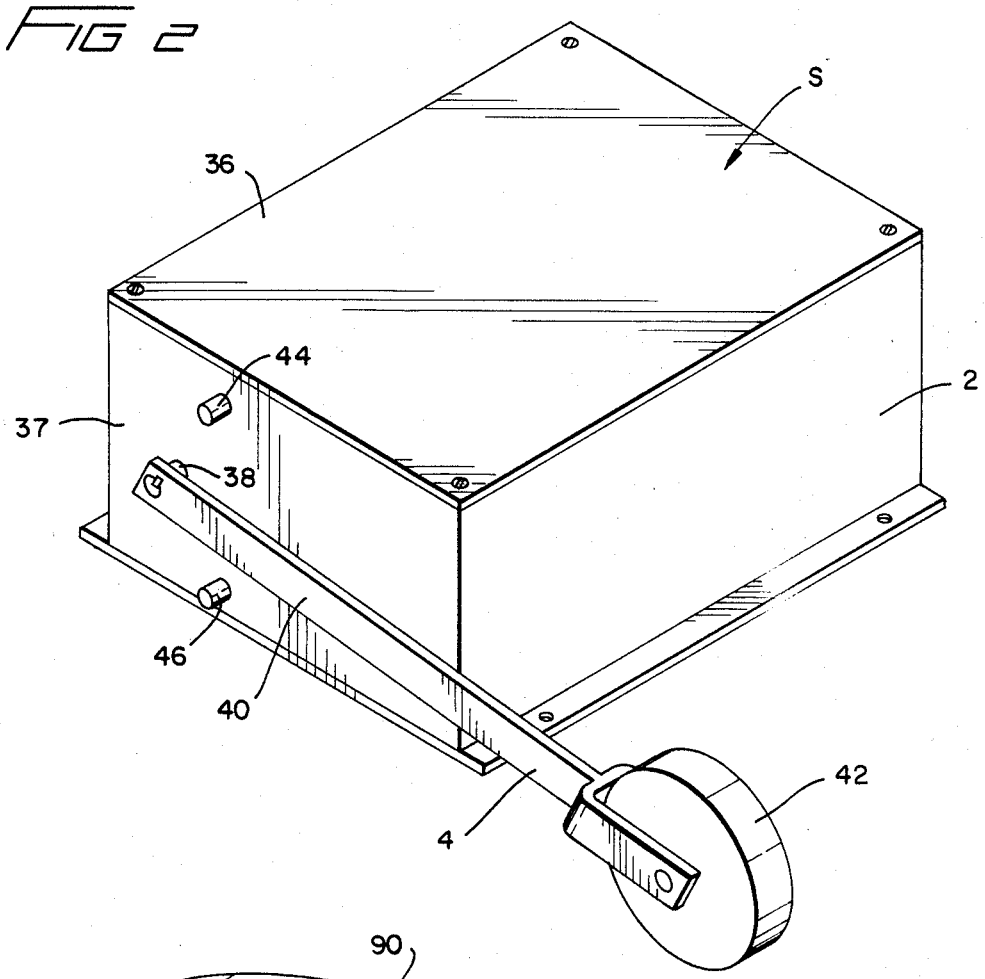
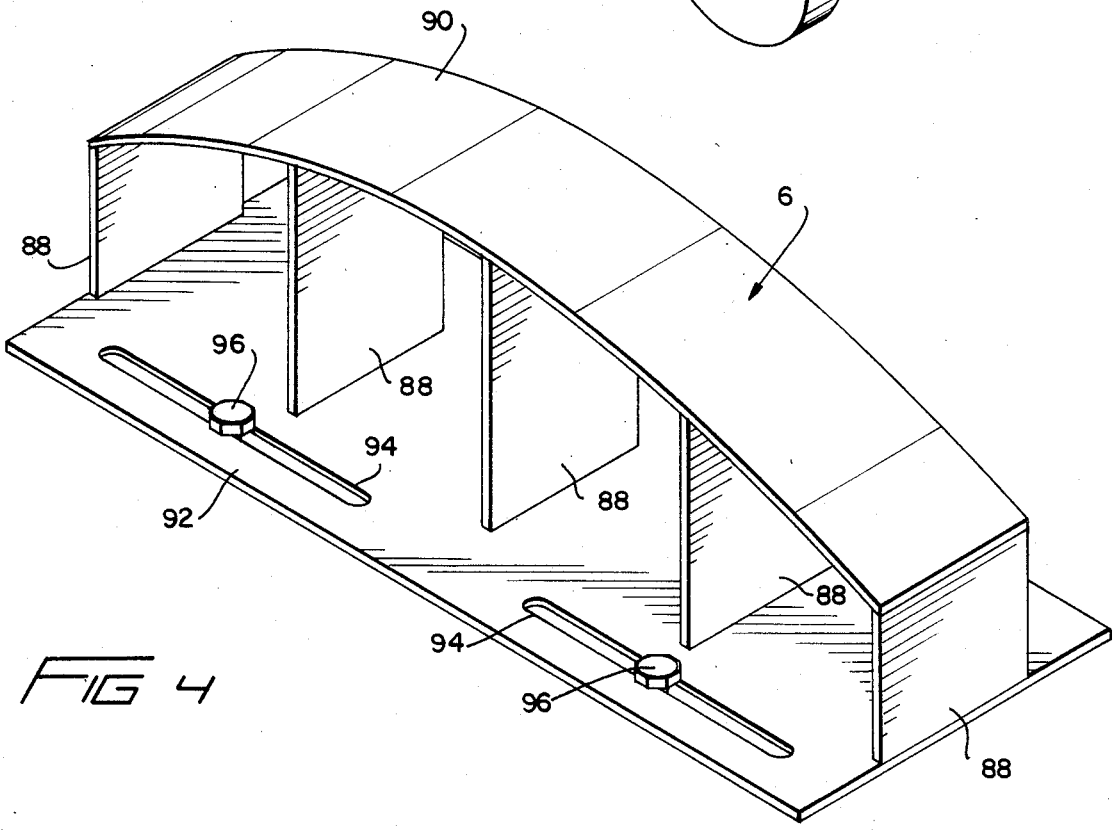
FIG 4

FIG 3
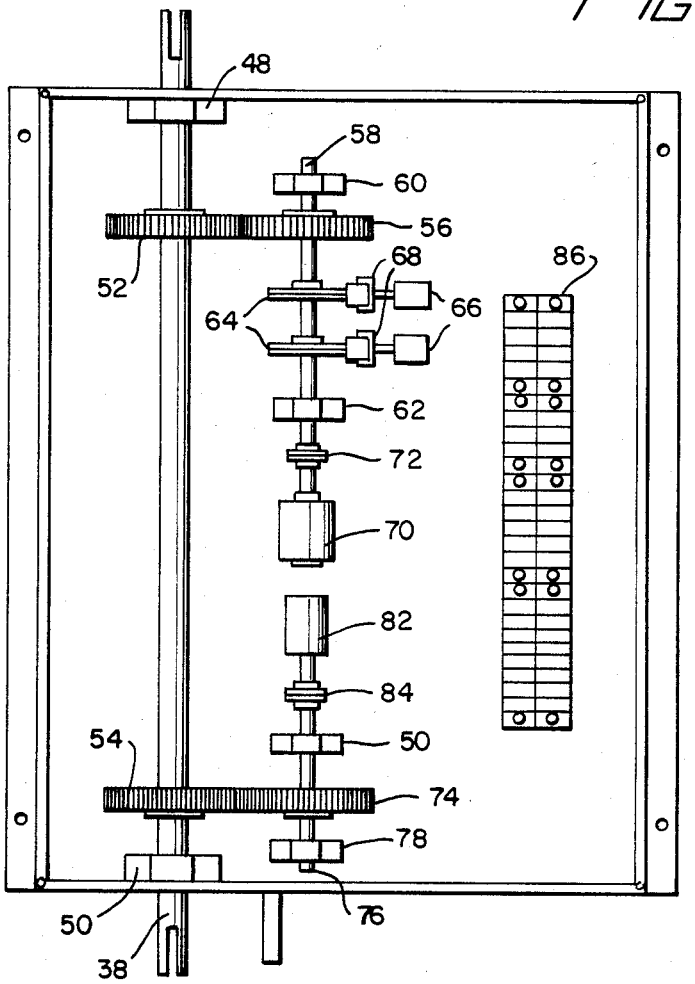
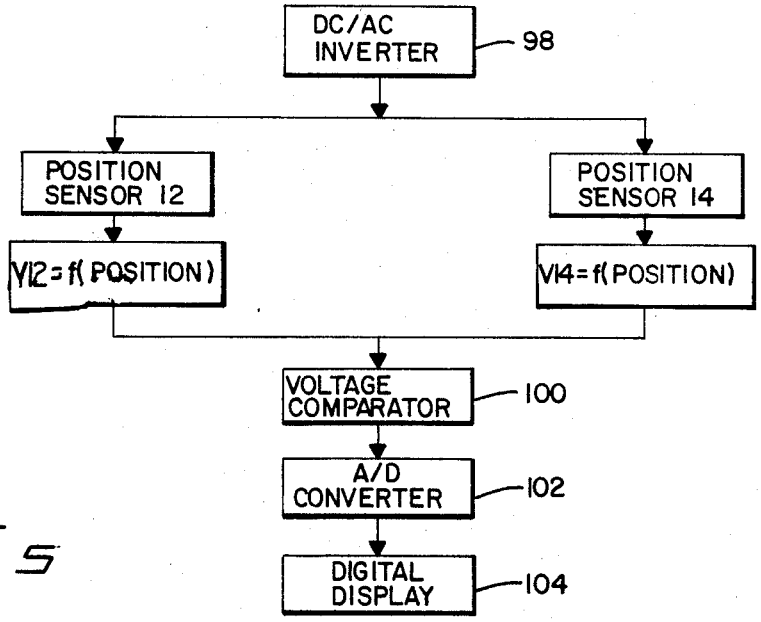
FIG 5

ANALOG CAM PROFILE SENSOR SYSTEM

BACKGROUND OF THE INVENTION

The present invention relates to a system for controlling the position of a bottom pour ladle relative to a plurality of bottom pouring locations. More particularly, the present invention relates to the precision positioning of a crane bridge and the precision positioning of a hoist trolley carried by the crane bridge and is especially useful in a system for semi-automatic precision positioning of an overhead crane dispensing molten steel into a mold configuration.

Although this invention is not limited in its utility to cranes dispensing molten steel, the present invention is particularly well suited for semi-automatic positioning of a teeming aisle hot metal crane in order to preposition the crane bridge and trolley so that the stream of molten metal being poured from the ladle will enter directly into the entry hole of an ingot bottom pour assembly.

In the past, support structure carrying devices, which had to be positioned by relative to a point of operation, were positioned reliance on limit switches. A primary disadvantage inherent in such limit switches is that they are of a binary type (on/off) sensor which does not indicate how close the device is to the point of operation. For example, when such limit switches are employed, an operator of an overhead crane dispensing molten steel will only receive information, regarding the position of the pour location relative to the crane, when the crane is in the pouring position. The operator receives no information regarding the pour location until the crane has reached the pouring position and only at that time will the operator know that the bottom pour ladle is in alignment with the pour location. An obvious disadvantage to a positioning system using limit switches is that the operator will often overtravel the pouring position and be forced to estimate the crane movement necessary to bring the bottom pour ladle into alignment with the pouring position. Miscalculations on the part of the operator may result in the crane running into objects during the positioning of the crane and also misdirecting the stream of molten metal as it is poured, thereby resulting in splashes about the exterior of the mold.

U.S. Pat. No. 4,033,403, issued to Seaton et al., discloses a sensor mechanism which may be mounted on a molten metal pouring machine. The sensing means of Seaton et al. includes a beam which is allowed to contact moving molds or the like, the movement of the beam controlling limit switches and a signal generator. Although the system taught by Seaton et al. does include an override overtravel responsive switch, precise information regarding the position of the ladle relative to the mold is not realized by this system.

Other systems for controlling the position of a ladle relative to a mold or the like include: U.S. Pat. No. 4,144,675 issued to Buhrer; U.S. Pat. No. 4,210,192 issued to Lavanchy et al.; U.S. Pat. No. 4,230,308 issued to Gueguen; and, U.S. Pat. No. 4,084,631 issued to Kunzmann. However, none of the above mentioned patents contemplate the novel sensing and positioning system of the present invention.

OBJECTS AND SUMMARY OF THE INVENTION

It is an object of the present invention to provide a system for sensing the position of a bottom pour ladle relative to a pouring location and for providing a readout indicating the distance and direction of the pouring location relative to the bottom pour ladle.

It is an object of the present invention to provide a sensing means, for positioning a ladle, which produces an analog signal having an amplitude which will vary in a consistent and repeatable manner depending on the position of a cam follower moving relative to the center of prepositioned cam.

Another object of the invention is to provide means for accurately positioning a molten steel-carrying ladle, carried by a main hoist of a bridge crane or the like, such that when the metal is to be poured, it will pour directly into an intake hole of the ingot bottom pour assembly without splashing on the area adjacent the intake hole.

A further object of the present invention is to provide a sensing means for a support structure which produces an analog signal which may be displayed in a manner so as to give an operator of the movable support structure reliable information as to the position of the movable support structure relative to a point of operation.

It is a further object of the invention to provide a positioning means for a support structure or the like which is readily adaptable to industrial use and requires a minimum amount of maintenance.

Still another object of the present invention is to provide a positioning means for a movable structure which is simple in design, rugged in construction and economical to install.

Various features of novelty which characterize the present invention are pointed out with particularity in the claims annexed to and forming a part of this disclosure. For a better understanding of this invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 2 is a perspective view showing a sensing means enclosure having a rotary analog cam profile sensor associated therewith.

FIG. 3 is a top plan view of a sensor enclosure with the top portion of the enclosure cut away.

FIG. 4 is a perspective view of a cam assembly of the invention.

FIG. 5 is a schematic diagram showing a sensor system block diagram of the invention.

DESCRIPTION OF THE PREFERRED EMBODIMENT

Figure 1:
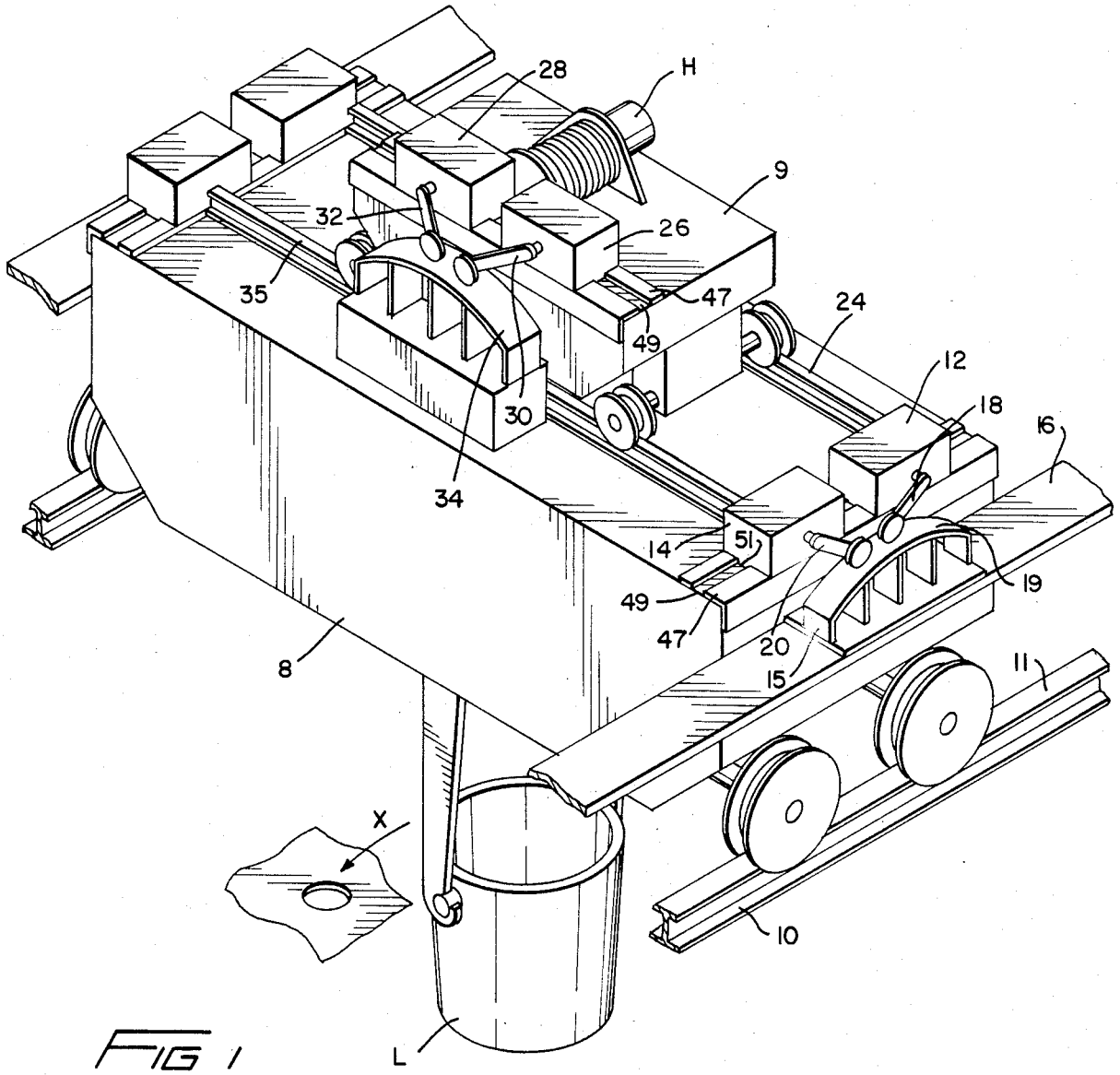
FIG. 1 is a perspective view showing a crane bridge having a sensing means mounted on the crane bridge for positioning the crane bridge and a second sensing means mounted on a main hoist trolley for positioning the hoist trolley.

Referring to the drawings in particular to FIG. 1, the invention embodied therein includes a position sensor generally designated S, adapted to position a crane bridge 8 and a hoist trolley 9 so that a ladle L will be precisely positioned above a pouring location X. The ladle L is supported by a hoist mechanism H which positions the ladle L in a vertical manner.

As seen in FIG. 2, a typical sensor S includes at least one sensor enclosure 2 having associated therewith at least one cam follower 4 which engages the cam assembly 6, best shown in FIG. 4.

In accordance with the invention, a movable crane bridge or movable structure 8 is mounted on crane rails 10 or the like so that the crane bridge 8 may be moved along a path or crane bridge trackway 11. A first crane bridge sensor assembly 12 and a second crane bridge sensor assembly 14 are mounted adjacent one another on crane bridge 8. A cam asembly 15 is fixed on a cam assembly support surface 16. The cam assembly 15 is positioned so as to be in alignment with the pouring location X. A first cam follower 18, associated with the first sensor assembly 12, is positioned so that it will engage cam track 19 of cam assembly 15 as the crane bridge 8 is moved along crane rails 10. A second cam follower 20, associated with second sensor assembly 14, is positioned so that it also engages cam track 19.

The main hoist trolley 9 is shown, in FIG. 1, positioned on crane bridge 8 and is mounted so that it is movable along trolley rails 24. A third sensor assembly 26 and a fourth sensor assembly 28, having respective third cam follower 30 and fourth cam follower 32, sense the position of trolley 9 relative to crane 8 as cam followers 30 and 32 engage cam 34 mounted on crane bridge 8. Main hoist trolley 9 is free to move along a trolley pathway or trackway 35 defined by trolley rails 24 and is positionable along the trolley trackway 35.

Each sensor enclosure 2 and associated cam follower 4 includes a sensor housing 36 having a side wall 37 with a cam follower shaft 38 passing therethrough, as best shown in FIGS. 2 and 3. The cam follower shaft 38 is keyed or the like to cam follower arm 40 which in turn supports cam follower wheel 42. Side wall 37 is provided with upper cam follower arm stop 44 and lower cam follower arm stop 46. Upper cam follower arm stop 44 acts to restrict the movement of cam follower arm 40 in an upward direction, whereas lower cam follower arm stop 46 restricts the movement of cam follower arm 40 in a downward direction.

Each sensor enclosure 2 is adjustably positioned relative to a sensor support 47 having a slot 49. The sensor support 47 may be mounted to crane bridge 8, trolley 9 or a similar movable support structure. A slot engaging protuberence or locking means 51 is fixedly attached to each sensor enclosure 2 and adapted to engage slot 49 so as to fix each sensor enclosure 2 relative to the movable support structure.

As can be seen in FIG. 3, within the interior of sensor enclosure 2 there is a first pedestal-type bearing 48 and a second pedestal type bearing 50 supporting cam follower shaft 38. Mounted on cam follower shaft 38 is a first precision gear 52 and a second precision gear 54. First precision gear 52 is adapted to engage third precision gear 56 mounted on first auxiliary shaft 58. First auxiliary shaft 58 is supported by pedestal type bearings 60 and 62 so that it is free to rotate as third precision gear 56 engages first precision gear 52. Mounted on first auxiliary shaft 58 there are two adjustable shaft position cams 64 which are used to detect when cam follower wheel 42 is out of engagement with cam assembly 6. For example, when cam follower wheel 42 is out of engagement with cam assembly 6, cam follower arm 40 will be in the lowermost position and first auxiliary shaft 58 will be in a position corresponding to the lowermost position of cam follower arm 40. When this occurs, a cam operated switch 66 having an adjustable shaft position cam follower 68 will be activated by adjustable shaft position cam 64, thereby changing the electrical state of switch 66 to correspond to the cam follower arm 40 being in the lowermost position.

Coupled to first auxiliary shaft 58 is torque motor 70. Torque motor 70 is coupled to first auxiliary shaft 58 by means of a zero backlash shaft coupling 72 which permits minimal play between the rotation of torque motor 70 and the rotation of first auxiliary shaft 58. Torque motor 70 applies a constant torque on first auxiliary shaft 58 so that a constant downward pressure is applied on cam follower arm 40, thereby keeping cam follower wheel 42 in engagement with fixed cam 6.

Fourth precision gear 74 is rotatably mounted on a second auxiliary shaft 76 and is in engagement with second precision gear 54. Second auxiliary shaft 76 is mounted to bearings 78 and 50 so that it is free to rotate as fourth precision gear 74 rotates. Coupled to second auxiliary shaft 76 is an analog shaft angle resolver 82. Analog shaft angle resolver 82 measures the degree of rotation of second auxiliary shaft 76, the rotation of which directly corresponds to the rotation of cam follower shaft 38. Analog shaft angle resolver 82 is coupled to second auxiliary shaft 76 by means of a zero backlash shaft coupling 84. Zero backlash shaft coupling 84 permits minimal play between analog shaft angle resolver 82 and second auxiliary shaft 76. This greatly increases the precision of analog shaft angle resolver 82.

Terminal blocks 86 are provided within sensor enclosure 2 so that electrical signals from the cam operated switches 66 and the analog signal from shaft angle resolver 82 may be transmitted to the operator of the crane bridge 8 and trolley 9.

As best seen in FIG. 4, cam assembly 6 includes a plurality of support members 88 supporting arcuate cam surface 90 and maintain cam surface 90 in fixed relationship with base plate 92. Base plate 92 may include bolt holes or the like to fasten cam assembly 6 to the support or the like. Preferably, base plate 92 includes slots 94 which receive bolts or the like for fastening the base plate 92 to a support structure or the like. By the use of such slots 94, bolts 96 may be inserted within the slots and secured to a support structure or the like and then tightened down so that base plate 92 is fixed to the support structure. Loosening bolts 96 allows base plate 92 to be moved along the line of slots 94 for thereby permitting repositioning of cam surface 90.

Referring now in particular to FIG. 5, there is shown a system block diagram for the first sensor assembly 12 and second sensor assembly 14. One of ordinary skill in the art will readily appreciate that a similar system may be used for third sensor assembly 26 and fourth sensor assembly 28. A dc/ac inverter 98 receives a DC input voltage from a storage battery or the like and outputs a sine wave of desired amplitude for use with the position sensors 12 and 14 so that, for each sensor 12 and 14, an output signal is transmitted having a voltage which is a function of the position of first cam follower 18 and second cam follower 20, respectively. These signals are fed into a voltage comparator 100 which compares the first voltage, termed $V_{12}$, to a second voltage, termed $V_{14}$. The comparator then outputs a signal $V_{analog}$ which represents the difference between these two voltages. Analog signal $V_{analog}$ is then fed into an analog/-digital convertor 102. The analog signal is periodically sampled and each sample is converted from an analog signal to a digital signal. This provides a n bit binary number proportional to the value of the signal sample. The digital signals which are provided by the analog/-digital convertor are then fed to a digital display 104 which displays a number which is proportional to the distance the cam followers 18 and 20 are from a predetermined position along the cam assembly 6. This corresponds to the distance of the ladle L from the pouring position X along either crane bridge trackway 11 or trolley trackway 35.

Figure 6:
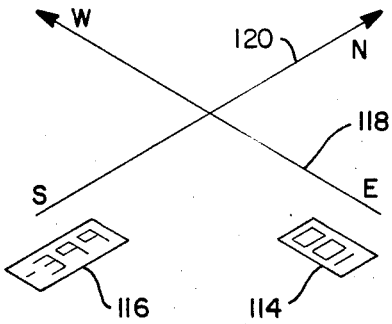
FIG. 6 is a schematic view showing the digital displays of the invention.

For example, a crane operator would have two digital displays 114 and 116, as best shown in FIG. 6. Digital display 114 may be mounted in the direction of the motion of trolley 9, the east-west direction 118. The other digital display 116 may be mounted in the direction of the motion of bridge crane 8 or the north-south direction 120. When the crane trolley 9 is approaching the predetermined eastwest pouring position, the digital display 114 showing the position of trolley 9 relative to the pouring location X, will start by displaying a high negative number (i.e. "−399") and as trolley 9 approaches the predetermined position, the number will go down towards zero. In this manner, when the trolley reaches the correct pouring position, digital display 114 will read "0". If the trolley 9 overshoots the predetermined position, the trolley display will start reading positive numbers proportional to the amount of overtravel with respect to the predetermined position. When the trolley is brought back to the predetermined position, digital display 114 will again read "0". In a similar manner, the crane bridge 8 may be positioned in the north south direction to a number of predetermined positions corresponding to the number of cams 6 which are fixed adjacent crane rails 10. When both displays are reading "0" (i.e. trolley and bridge are both in the predetermined position), the structure, crane or the like carried by trolley 9 and crane bridge 8, is positioned for further operations to take place.

While this invention has been described as having preferred design, it is understood that it is capable of further modification, uses and/or adaptations of the invention following in general the principle of the invention and including such departures from the present disclosure as come within known or customary practice in the art to which the invention pertains, and as may be applied to the essential features set forth, and fall within the scope of the invention of the limits of the appended claims.

What is claimed is:

1. An apparatus for positioning a ladle relative to a pouring location, comprising:

(a) a crane bridge assembly movable along a crane bridge trackway in a first direction and including a hoist trolley assembly movable along said crane bridge assembly in a second direction transverse to said first direction and carrying a ladle;

(b) a first contoured cam position proximate said crane bridge assembly and being associated with a pouring location;

(c) first sensor means mounted to said crane bridge assembly and movable therewith and including first cam follower means engageable with said first cam and generating a signal indicative of engagement with and the position of said first sensor means along said first cam;

(d) crane bridge position indicating means connected with said first sensor means including means responsive to the generated signal for determining and indicating the position of said crane bridge assembly relative to the pouring location;

(e) a second contoured cam positioned on said crane bridge assembly proximate said hoist trolley assembly and being associated with the pouring location;

(f) second sensor means mounted to said hoist trolley assembly and movable therewith and including second cam follower means engageable with said second cam and generating a signal indicative of engagement with and the position of said second sensor means along said second cam; and, (g) hoist trolley position indicating means connected with said second sensor means and including means responsive to the generated signal for determining and indicating the position of said hoist trolley assembly relative to the pouring location.

2. The apparatus of claim 1, wherein:

(a) said first sensor means including first and second spaced apart switch means, each of said switch means including a pivotal cam follower and means generating a signal indicative of engagement with and the position of the associated cam follower along said first cam.

3. The appartaus of claim 2, wherein:

(a) each of said switch means including a first rotatable shaft to which the associated cam follower is mounted;

(b) first gear means being mounted to and rotatable with said first shaft;

(c) each of said switch means further including a second rotatable shaft;

(d) second gear means being mounted to and rotatable with said second shaft and being engaged with said first gear means for being rotated thereby; and, (e) shaft angle resolver means being coupled to said second shaft of each of said switch means and generating a signal proportional to the degree of rotation of the associated second shaft and thereby corresponding to the degree of rotation of the associated first shaft.

4. The apparatus of claim 3, wherein:

(a) said crane bridge position indicating means including signal comparator means operating on the signals of said shaft angle resolver means and generating a composite signal representing the difference between the signals of said first and second switch means and said composite signal being proportional to the distance of said crane bridge assembly from the pouring location.

5. The apparatus of claim 3, wherein:

(a) third gear means being mounted to and rotatable with the first shafts of said first and second switch means;

(b) said first and second switch means further including a third rotatable shaft;

(c) fourth gear means being mounted to and rotatable with the third shafts of said first and second switch means and being engaged with the associated third gear means and being rotated thereby; and, (d) first and second cam switches operably associated with each of said fourth gear means, one of said cam switches operative to indicate engagement of the associated cam follower with said first cam and the other cam switch operative to indicate non-engagement of the associated cam follower with said 6. The apparatus of claim 2, wherein:

(a) said signal generating means including means for indicating engagement of the cam follower with said first cam and means for determining the amount of pivoting of the cam follower.

7. The apparatus of claim 6, wherein:

(a) said means for determining the amount of pivoting including a shaft angle resolver generating an analog signal proportional to the degree of pivoting of the cam follower.

8. The apparatus of claim 7, wherein:

(a) said crane bridge position indicating means including signal comparator means generating a composite signal representing the difference between the analog signals of said switch means and said composite signal being proportional to the distance of said crane bridge assembly from the pouring location.

9. The apparatus of claim 8, wherein:

(a) a digital display associated with said crane bridge position indicating means for displaying the distance of said crane bridge assembly from the pouring location.

10. The apparatus of claim 1, wherein:

(a) said second sensor means including third and fourth spaced apart switch means, each of said third and fourth switch means including a pivotal cam follower and means generating a signal indicative of engagement with and the position of the associated cam follower along said second cam.

11. The apparatus of claim 10, wherein:

(a) said second sensor means signal generating means including means indicating engagement of the associated cam followers with said second cam and means for determining the amount of pivoting of the associated cam followers.

12. The apparatus of claim 11, wherein:

(a) said second sensor means means for determining the amount of pivoting including a shaft angle resolver for each of said third and fourth switch means generating an analog signal proportional to the degree of pivoting of the associated cam followers.

13. The apparatus of claim 12, wherein:

(a) said hoist trolley position indicating means including second signal comparator means generating a second composite signal representing the difference between the analog signals of said third and fourth switch means and being proportional to the distance of said hoist trolley assembly from the pouring location.

14. The apparatus of claim 10, wherein:

(a) each of said third and fourth switch means including a first rotatable shaft to which the associated cam follower is connected;

(b) first gear means being mounted to and rotatable with the first shaft of each of said third and fourth switch means;

(c) each of said third and fourth switch means further including a second rotatable shaft;

(d) second gear means having mounted to and rotatable with the second shaft of each of said third and fourth switch means and being engaged with and rotated by the first gear means of said third and fourth switch means; and, (e) shaft angle resolver means being coupled to the second shaft of each of said third and fourth switch means and generating a signal proportional to the degree of rotation of the second shafts of said third and fourth switch means and thereby corresponding to the degree of rotation of the associated first shafts.

15. The apparatus of claim 14, wherein:

(a) said hoist trolley position indicating means including signal comparator means operating on the signals of said shaft angle resolver means of said third and fourth switch means and generating a second composite signal representing the difference between the signals of said third and fourth switch means and being proportional to the distance of said hoist trolley assembly from the pouring location.

16. The apparatus of claim 14, wherein:

(a) third gear means being mounted to and rotatable with the first shafts of said third and fourth switch means;

(b) said third and fourth switch means further including a third rotatable shaft;

(c) fourth gear means being mounted to and rotatable with the third shafts of said third and fourth switch means and being engaged with and rotated by the associated third gear means; and, (d) third and fourth cam switches operably associated with each of said fourth gear means of said third and fourth switch means, one of said third and fourth cam switches operable to indicate engagement of the associated cam follower with said second cam and the other of said third and fourth cam switches operable to indicate non-engagement of the associated cam follower with said second cam.

17. The apparatus of claim 1, wherein:

(a) said first sensor means including first and second spaced apart switch means, each of said first and second switch means including a pivotal cam follower engagable with said first cam and means generating an analog signal indicative of engagement with and the position of the associated cam follower along said first cam;

(b) said second sensor means including third and fourth first cam. spaced apart switch means, each of said third and fourth switch means including a pivotal cam follower engagable with said second cam and means generating an analog signal indicative of engagement with and the position of the associated cam follower along said second cam;

(c) said crane bridge position indicating means including means operating on the analog signals of said first and second switch means for determining the distance from and indicating the distance of said crane bridge assembly from the pouring location;

(d) said hoist trolley indicating means including means operating on the analog signals of said third and fourth switch means for determining and indicating the distance of said hoist trolley assembly from the pouring location; and, (e) display means associated with said crane bridge and hoist trolley position indicating means for displaying the distance thereof to the pouring location.

18. A pouring location distance determining assembly, comprising:

(a) a crane bridge assembly movable along a crane bridge trackway in a first direction and including a hoist trolley assembly movable along said crane bridge assembly in a second direction transverse to said first direction and carrying a bottom pour ladle;

(b) a first concave cam positioned proximate said crane bridge assembly and being associated with a pouring location;

(c) first and second spaced apart sensor means mounted to said crane bridge assembly and movable therewith and each of said first and second sensor means including a pivotal cam follower engagable with said first cam and further including means generating a signal indicative of engagement with and the position of the associated cam follower along said first cam;

(d) a second concave cam positioned on said crane bridge assembly proximate said hoist trolley assembly and being associated with the pouring location;

(e) third and fourth spaced apart sensor means mounted to said hoist trolley assembly and movable therewith and each of said third and fourth sensor means including a pivotal cam follower engagable with said second cam and further including means generating a signal indicative of engagement with and the position of the associated cam follower along said second cam;

(f) distance to pouring location indicating means operably associated with each of said switch means and including means operating on the signals of said first and second sensor means for determining the distance to the pouring location in said first direction and means operating on the signals of said third and fourth sensor means for determining the distance to the pouring location in said second direction; and, (g) display means operably associated with said indicating means for displaying the distance to the pour location in said first and second directions.

19. The assembly of claim 18, wherein:

(a) each of said sensor means including a first rotatable shaft to which the associated cam follower is mounted and which is rotated by pivoting of the cam follower;

(b) first and second spaced apart gear means being mounted to and rotatable with the first shaft of each sensor means;

(c) each of said sensor means further including a third and fourth rotatable shaft;

(d) each of said third shafts carrying a third gear means engaged with and rotated by the associated second gear means;

(e) first and second switches being operably associated with each of said third shafts and a first one of said switches being operative to indicate engagement of the associated cam follower with the associated cam and the other one of said switches being operative to indicate non-engagement of the associated cam follower with the associated cam;

(f) each of said fourth shafts carrying a fourth gear means engaged with and rotated by the associated first gear means; and, (g) shaft angle resolver means being coupled to each of said fourth shafts and generating a signal representing the degree of rotation of the associated fourth shaft and thereby corresponding to the degree of pivoting of the associated cam follower.

20. The assembly of claim 18, wherein:

(a) said indicating means including first signal comparator means generating a first composite signal representing the difference between the shaft angle resolver means signals of said first and second sensor means and the first composite signal representing the distance in said first direction of said crane bridge assembly to the pouring location; and, (b) said indicating means further including second signal comparator means generating a second composite signal representing the distance between the signals of said third and fourth shaft angle resolver means and the second composite signal representing the distance in said second direction of said hoist trolley assembly to the pouring location.

* * * * *